US007815523B2

(12) United States Patent
Knutson et al.

(10) Patent No.: US 7,815,523 B2
(45) **Date of Patent: *Oct. 19, 2010**

(54) VARIABLE DENSITY GOLF CLUB

(75) Inventors: Scott A. Knutson, Escondido, CA (US); Peter J. Gilbert, Carlsbad, CA (US); Thomas O. Bennett, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 690 days.

This patent is subject to a terminal disclaimer.

(21) Appl. No.: 10/915,458

(22) Filed: Aug. 11, 2004

(65) Prior Publication Data

US 2006/0035721 A1 Feb. 16, 2006

(51) Int. Cl.
*A63B 53/04* (2006.01)

(52) U.S. Cl. ..... 473/349; 473/350

(58) Field of Classification Search ..... 473/324–350
See application file for complete search history.

(56) References Cited

U.S. PATENT DOCUMENTS

| | | | | |
|---|---|---|---|---|
| 4,992,236 | A | 2/1991 | Shira | 419/28 |
| 5,062,638 | A | 11/1991 | Shira | 473/350 |
| 5,584,770 | A * | 12/1996 | Jensen | 473/350 |
| 5,658,208 | A * | 8/1997 | Shimasaki | 473/349 |
| 5,749,794 | A * | 5/1998 | Kobayashi et al. | 473/342 |
| 5,788,584 | A | 8/1998 | Parente et al. | 473/290 |
| 6,015,354 | A | 1/2000 | Ahn et al. | 473/256 |
| 6,027,415 | A | 2/2000 | Takeda | 473/291 |
| 6,030,293 | A * | 2/2000 | Takeda | 473/334 |
| 6,093,112 | A | 7/2000 | Peters et al. | 473/291 |
| 6,200,228 | B1 * | 3/2001 | Takeda | 473/324 |
| 6,290,607 | B1 | 9/2001 | Gilbert et al. | 473/291 |
| 6,364,788 | B1 | 4/2002 | Helmstetter et al. | 473/324 |

(Continued)

FOREIGN PATENT DOCUMENTS

JP 06343722 A * 12/1994

(Continued)

OTHER PUBLICATIONS

Callister, Jr., William D. Materials Science and Engineering, 4th Edition. New York: John Wiley & Sons, Inc, copyright 1997, p. 775.*

*Primary Examiner*—Alvin A Hunter
(74) *Attorney, Agent, or Firm*—Hanify & King, P.C.

(57) ABSTRACT

A golf club head having portions of varying density is disclosed and claimed. The club head includes a body with a recess in the back between the heel and toe and extending toward the sole. An insert that is configured to matingly correspond to the recess is positioned within the recess. The insert has a lower specific gravity than the club head body, biasing the club head mass toward the club head perimeter. The insert can form a muscle of the club head. The club head is forged, and the recess is formed by machining. After the insert is positioned within the recess, the club head-insert combination is subjected to additional forging and finishing steps. The present invention increases the club head moment of inertia and/or enlarges the club head sweet spot while retaining the golfer's ability to work the golf ball and shape the golf shot. The present invention can be used with forged, blade, and muscle back clubs, which have not heretofore been enhanced in these manners.

28 Claims, 4 Drawing Sheets

U.S. PATENT DOCUMENTS

| | | | | |
|---|---|---|---|---|
| 6,434,811 | B1 | 8/2002 | Helmstetter et al. | 29/407.08 |
| 6,440,010 | B1 | 8/2002 | Deshmukh | 473/335 |
| 6,447,715 | B1 | 9/2002 | Amick | 420/430 |
| 6,482,104 | B1 | 11/2002 | Gilbert | 473/287 |
| 6,508,978 | B1 | 1/2003 | Deshmukh | 419/5 |
| 6,592,469 | B2 * | 7/2003 | Gilbert | 473/350 |
| 6,863,625 | B2 * | 3/2005 | Reyes et al. | 473/342 |
| 6,902,495 | B2 * | 6/2005 | Pergande et al. | 473/332 |
| 6,921,344 | B2 * | 7/2005 | Gilbert et al. | 473/334 |
| 2002/0042307 | A1 | 4/2002 | Deshmukh | 473/335 |
| 2002/0124759 | A1 | 9/2002 | Amick | 102/439 |
| 2003/0000341 | A1 | 1/2003 | Amick | 75/352 |
| 2003/0092499 | A1 | 5/2003 | Gilbert | 473/291 |
| 2003/0143099 | A1 | 7/2003 | Amick | 419/65 |
| 2003/0153397 | A1 | 8/2003 | Roach et al. | 473/290 |

FOREIGN PATENT DOCUMENTS

| | | | |
|---|---|---|---|
| JP | 08-38657 | | 2/1996 |
| JP | 09117537 | A * | 5/1997 |
| JP | 10-151231 | | 6/1998 |
| JP | 11104283 | A * | 4/1999 |
| JP | 2001029521 | A * | 2/2001 |
| JP | 2002-35176 | | 2/2002 |
| JP | 2002065913 | A * | 3/2002 |

* cited by examiner

VARIABLE DENSITY GOLF CLUB

BACKGROUND OF THE INVENTION

1. Field of the Invention

The present invention relates to a golf club, and, more particularly, to a forged iron-type golf club head having portions of varying density.

2. Description of the Related Art

Iron-type golf clubs generally include a front or striking face, a top line, and a sole. The front face interfaces with and strikes the golf ball. A plurality of score lines or grooves is provided on the face to assist in imparting spin to the ball. The top line is generally configured to have a particular look to the golfer and to provide weight. The sole of the golf club is particularly important to the golf shot because it contacts and interacts with the ground during the swing.

In conventional sets of iron-type golf clubs, each club includes a shaft with a club head attached to one end and a grip attached to the other end. The club head includes a face for striking a golf ball. The angle between the face and a vertical plane is called the loft angle.

The set generally includes irons that are designated number 2 through number 9, and a pitching wedge. Other wedges, such as a lob wedge, a gap wedge, and a sand wedge, may be optionally included with the set. Each iron has a shaft length that usually decreases through the set as the loft for each club head increases from the long irons to the short irons. The length of the shaft, along with the club head loft, moment of inertia, and center of gravity location, impart various performance characteristics to the ball's launch conditions upon impact and determine the distance the ball will travel. Flight distance generally increases with a decrease in loft angle. However, difficulty of use also increases with a decrease in loft angle.

Iron-type golf clubs generally can be divided into three categories: blades, muscle backs, and cavity backs. Blades are traditional clubs with a substantially uniform appearance from the sole to the top line, although there may be some tapering from sole to top line.

Muscle backs have a substantially traditional appearance and are similar to blades, but have extra material on the back. This extra material, which may be in the form of a rib, can be used to lower the club head center of gravity. Having the club head center of gravity lower than the ball center of gravity at contact facilitates the golf shot.

Since blade and muscle back designs have a small sweet spot (that is, the area of the face that results in a desirable golf shot upon striking a golf ball), they are relatively difficult to use and are therefore typically only used by skilled golfers. However, these clubs have the benefit of producing longer golf shots than other designs. Furthermore, since these designs are typically made of relatively soft forged steel, they allow the golfer to work the ball and shape the golf shot as desired.

Cavity backs are modern designs that move some of the club mass to the perimeter of the club by providing a hollow or cavity in the back of the club, opposite the striking face. This produces a more forgiving club with a larger sweet spot. This also allows the size of the club face to be increased, also resulting in a larger sweet spot. The perimeter weighting created by the cavity also increases the club's moment of inertia, which is a measurement of the club's resistance to torque, for example the torque resulting from an off-center hit. These clubs are easier to hit than blades and muscle backs, and are therefore usable by less-skilled and beginner golfers.

Other known golf clubs achieve a desired balance or moment of inertia by adding a weight to the club. These clubs typically add a weight member to the bottom surface of the sole, in the center thereof.

SUMMARY OF THE INVENTION

The present invention relates to a golf club head having portions of varying density to increase the club head moment of inertia and/or enlarge the club head sweet spot. The present invention can be used with forged, blade, and muscle back clubs, which have not heretofore been enhanced in these manners.

The present invention is directed to a golf club head having a body defining a front surface, a top line, a sole, a back, a heel, and a toe. The back includes a recess extending toward the sole. An insert that is configured to matingly correspond to the recess is positioned within the recess. The body is formed of a material having a first specific gravity, and the insert is formed of a material having a second specific gravity less than the first specific gravity. The insert and the difference in specific gravities biases the club head mass towards the club head perimeter, improving the club head moment of inertia and enlarging the sweet spot.

The insert, which may be metallic, provides a solid feel to the golf club, consistent with the feel of forged, blade, and muscle back iron-type golf clubs. The insert may extend above the recess along the back of the club head to form a muscle of the club head. The back preferably may be substantially free of any cavity. Thus, the present invention improves the moment of inertia and enlarges the sweet spot size while retaining the ability to allow the user to work the ball and shape the golf shot as desired.

Forging is a preferred method of forming the golf club head of the present invention. An exemplary process of forging the golf club head of the present invention includes providing a predetermined amount of a first material, such as in the form of an ingot. The ingot may be heated to an elevated temperature and then placed in a primer die and subjected to one or more forging compressions or impacts. Unwanted displaced material, or flash, may then be removed from the resulting club head precursor.

The recess is then formed by removing a portion of the precursor club head. This is preferably done by machining, such as with a computer numerically controlled milling machine. These types of machines allow precise control over the machining process and the tolerances of the resulting work product. The insert is then positioned within the recess, substantially filling it, forming a second club head precursor. This second precursor may then be subjected to additional forging and finishing steps to form the golf club head of the present invention. The insert preferably contains a lock groove and, optionally, a rib. These features will swage with the body material during forging to fixedly retain the insert within the recess.

The golf club head may be formed of materials having varying densities. To facilitate closing the club head during a golf swing and to provide an increase in moment of inertia, a lower portion of the toe and/or an upper portion of the hosel have greater densities than the main portion of the club head.

DESCRIPTION OF THE DRAWINGS

The present invention is described with reference to the accompanying drawings, in which like reference characters reference like elements, and wherein.

DETAILED DESCRIPTION OF THE INVENTION

Other than in the operating examples, or unless otherwise expressly specified, all of the numerical ranges, amounts, values, and percentages, such as those for amounts of materials, moments of inertias, center of gravity locations, and others in the following portion of the specification, may be read as if prefaced by the word "about" even though the term "about" may not expressly appear with the value, amount, or range. Accordingly, unless indicated to the contrary, the numerical parameters set forth in the following description and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in any specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Figure 1:
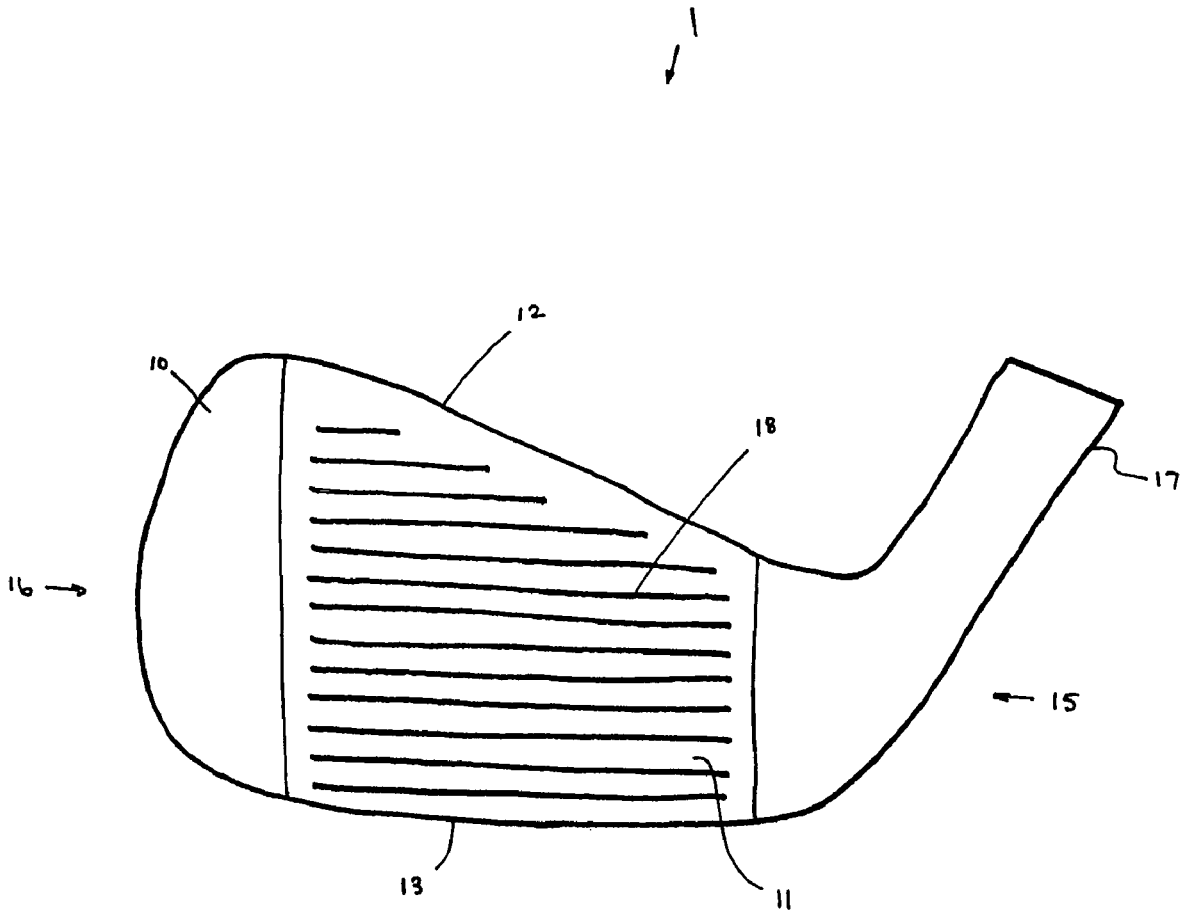
FIG. 1 shows the front side of a golf club head of the present invention.

FIG. 1 shows the front side of a golf club head 1 of the present invention. The golf club head 1 includes a body 10 defining a front surface 11, a top line 12, a sole 13, a back 14, a heel 15, a toe 16, and a hosel 17. The striking face of the front surface 11, which preferably contains grooves 18 therein, and the sole 13 may be unitary with the body 10, or they may be separate bodies, such as inserts, coupled thereto. The club head 1 preferably is a forged iron-type golf club head.

Figure 2:
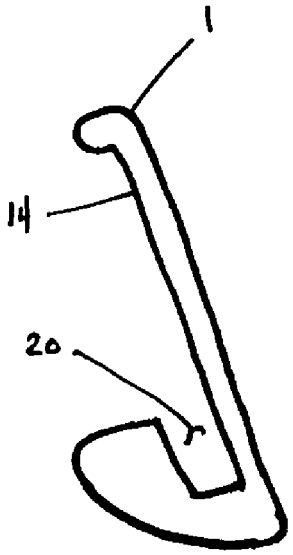
FIG. 2 shows a cross-sectional view through the golf club head of FIG. 1.

FIG. 2 shows a cross-sectional view through the golf club head 1. As seen in FIG. 2, the back 14 contains a recess 20 therein, located between the heel 15 and the toe 16 and extending toward the sole 13. The recess 20 removes material from the club head 1, which inherently provides more of the club head mass towards the perimeter of the club head 1, producing a greater moment of inertia (MOI) measured about a vertical axis passing through the club head center of gravity, increasing the size of the club head sweet spot, and lowering the club head center of gravity. Inertia is a property of matter by which a body remains at rest or in uniform motion unless acted upon by some external force. MOI is a measure of the resistance of a body to angular acceleration about a given axis, and is equal to the sum of the products of each element of mass in the body and the square of the element's distance from the axis. Thus, as the distance from the axis increases, the MOI increases, making the club more forgiving for off-center hits. Moving or rearranging mass to the club head perimeter enlarges the sweet spot and produces a more forgiving club.

Figure 3:
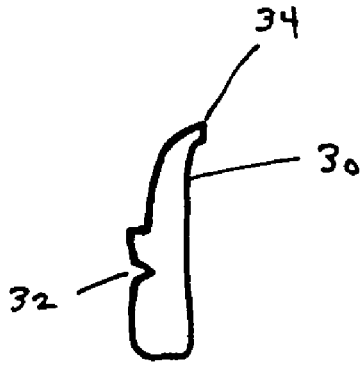
FIG. 3 shows a cross-sectional view through an insert for use with the golf club head of FIG. 1.
Figure 4:
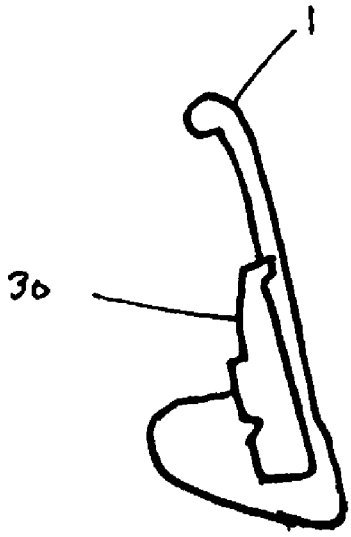
FIG. 4 shows the cross-sectional view of FIG. 2 with the insert of FIG. 3 in place.

FIG. 3 shows an insert 30 for use with the golf club head 1. The insert 30 is configured to matingly correspond to the recess 20. That is, the insert 30 is formed and configured to match the contours of the recess 20 and to substantially fill the recess 20. When positioned within the recess 20, as shown in FIG. 4, the insert 30 and the body 10 preferably form a substantially solid entity. The insert 30 may extend above the upper edge of the recess 20 and along the back 14 to form a muscle of the club head 1. Preferably, the back 14 is substantially free of any cavity. Thus, the present invention can provide an improved MOI and enlarged sweet spot for a non-cavity back iron-type golf club.

The insert 30 is formed of a material having a specific gravity less than the specific gravity of the material of the body 10. The difference between the specific gravity of the body 10 and the specific gravity of the insert 30 preferably is at least 3. The body 10 may have a specific gravity of at least 8. The insert 30, which may be metallic or plastic, may have a specific gravity of at most 8 or, more preferably, at most 5. Thus, the insert 30 biases the club head mass toward the perimeter thereof, increasing the club head MOI and enlarging the sweet spot, while also providing a solid feel consistent with forged iron-type golf clubs and allowing the user to work the ball and shape the golf shot as desired.

The club head 1 can be formed in a variety of manners. A preferred method of forming the golf club head 1 includes providing a predetermined amount of a first material. Various manufacturing techniques or steps are performed on the first material to form a first golf club precursor. For example, the predetermined amount of the first material may be provided in the form of an ingot. The ingot may be heated to an elevated temperature and then placed in a primer die and subjected to one or more forging compressions or impacts. Unwanted displaced material, or flash, may then be removed from the resulting club head precursor.

The recess 20 is then formed by removing a portion of the club head precursor. This removal may be performed by machining the precursor, preferably using a computer numerically controlled (CNC) machine, such as a CNC mill. These types of machines allow a high degree of precision and control over the machining process and tight tolerances in the resulting work piece. Thus, the recess 20 may be created to precise dimensions.

The insert 30, which has also been created to precise dimensions and is configured to matingly correspond to the recess 20, is then positioned within the recess 20. Since both the recess 20 and insert 30 have been created to tight tolerances, the second golf club head precursor formed by the body-insert union is substantially solid, having the attributes usually associated with blade and muscle back golf clubs. The second precursor is then subjected to additional manufacturing steps, such as heat treating and additional forging impacts, and club head finishing steps, such as hosel bore and groove creation, polishing, buffing, and cleaning, to form the finished golf club head of FIG. 4.

The insert 30 preferably includes a lock groove 32 and, optionally, a rib 34. After the insert 30 is positioned within the recess 20 and the second precursor is subjected to forging impacts, the body 10 opposite the lock groove 32 will swage into the lock groove 32, locking the insert 30 in place and coupling the body 10 and the insert 30. Likewise, the rib 34 will swage into the body 10. The rib 34 will also impose a preload upon the body 10.

Figure 5:
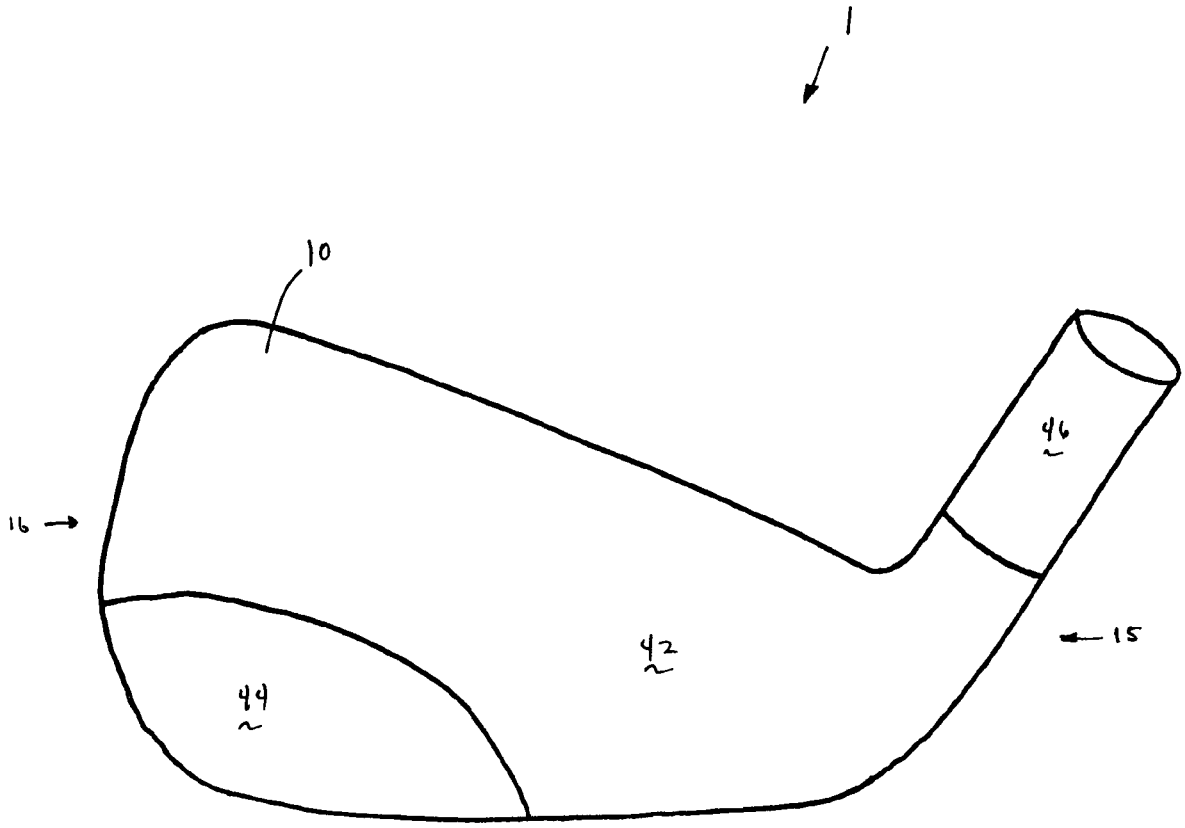
FIG. 5 shows a front view of another golf club head of the present invention.

As another way to enhance the playing characteristics of the golf club head 1, in conjunction with the insert 30 or independently, the body 10 may be of varying density. For example, as shown in FIG. 5, the body 10 of the club head 1 may be comprised of a plurality of materials of varying density. A main portion 42 of the body 10 preferably is comprised a first material having a first density. A second portion 44 of the body 10 may be situated in the toe area 16 of the club head 1, preferably in a lower portion of the toe area. The second portion 44 preferably has a density greater than the density of the main portion 42. Providing a denser material in the lower toe area 44 facilitates closing the club head 1 during the golf swing, which makes it easier to hit a desirable golf shot. A common swing problem, especially with mid- to high-handicap golfers, is failure to close the club head at impact. This swing flaw typically results in a blocked shot to the right or inducing a slice spin (that is, clockwise rotation for a right-handed golfer) to the ball.

A hosel portion 46 of the body 10 may also be provided in a different material than the main body portion 42. The hosel portion, which preferably is high on the hosel, is relatively far away from the club head center of gravity. Thus, placing more mass or a denser material, even in small amounts, in hosel portion 46 will result in a pronounced increase in the club head MOI, increasing the playability of the golf club.

The body 10 may be a unitary body. That is, the body 10, including materials of varying densities, may be provided as a whole instead of achieving varying density by including inserts. The body 10 may be formed through a variety of methods, including, for example, powdered metallurgy or casting.

Preferred materials for the club head 1 include titanium or a titanium alloy for the main body portion 42 and tungsten or a tungsten alloy for the toe portion 44 and/or the hosel portion 46. The denser portion(s) of the club head 1, the toe portion 44 and/or the hosel portion 46, preferably has a specific gravity more than double the specific gravity of the main body portion 42. More preferably, the specific gravity of the main body portion 42 is several times the toe portion 44 and/or the hosel portion 46 specific gravity is several times the main body portion 42 specific gravity. In absolute terms, the main body portion 42 preferably has a specific from 2.5 to 7, and more preferably from 3.5 to 5.5, and the toe portion 44 and/or the hosel portion 46 preferably have a specific from 10 to 20, and more preferably from 15 to 20.

Figure 6:
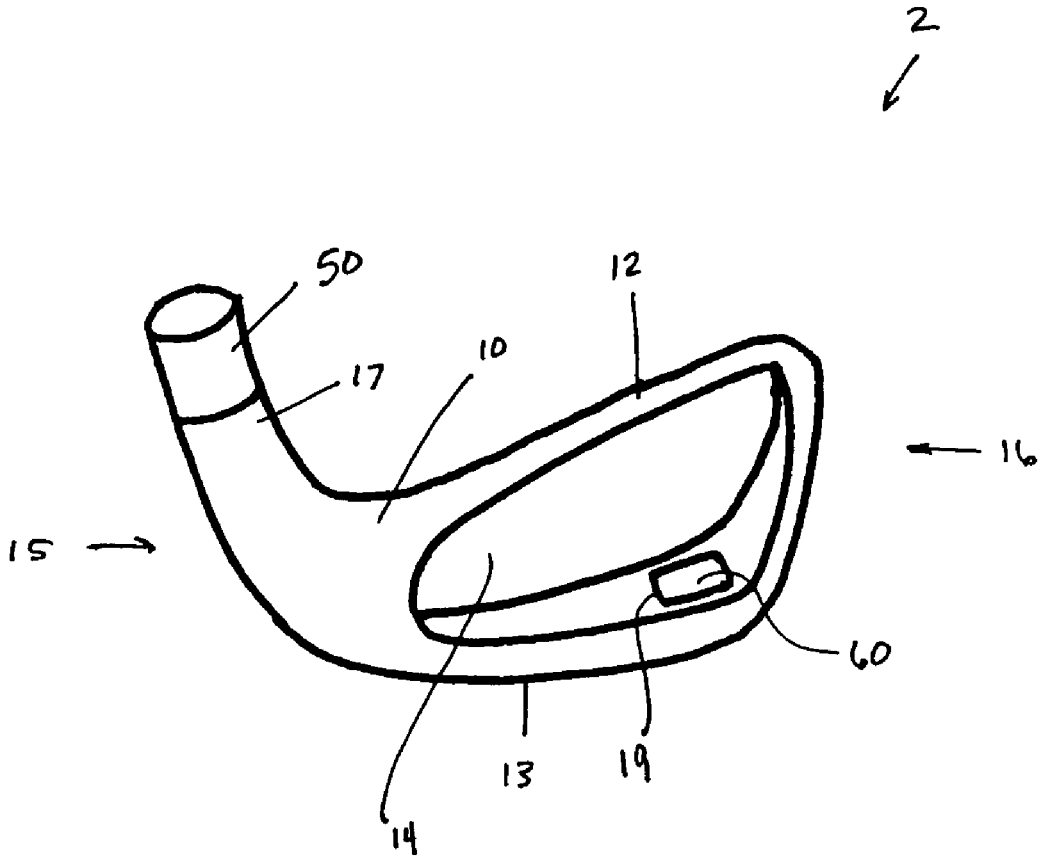
FIG. 6 shows a front view of another golf club head of the present invention.

FIG. 6 shows a front view of another golf club head 2 of the present invention. Like the previously discussed golf club head 1, the golf club head 2 includes a body 10 defining a front surface (not shown), a top line 12, a sole 13, a back 14, a heel 15, a toe 16, and a hosel 17. The body 10 may include titanium or a titanium alloy. The golf club head 2 further includes a hosel insert 50 and a toe insert 60. Preferably, the hosel insert 50 is a high hosel insert and the toe insert 60 is a low toe insert.

Figure 6A:
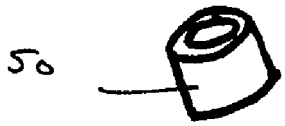
FIG. 6A shows a hosel insert of the golf club head of FIG. 6.

The hosel insert 50 may be a sleeve configured to overlie the hosel 17. The hosel insert 50 may be coupled to the hosel by press fit, bonding, or brazing. The hosel insert 50 may include tungsten or a tungsten alloy. FIG. 6A shows a view of the hosel insert 50.

Figure 6B:
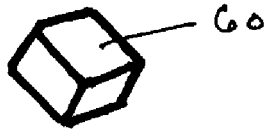
FIG. 6B shows a toe insert of the golf club head of FIG. 6.

The body 10 may include a recess 19 therein in or near the toe region 16 of the club head 2. The toe insert 60 is positioned within the recess 19. Preferably, the toe insert 60 is configured to substantially fill the recess 19. The toe insert 60 may include tungsten or a tungsten alloy. FIG. 6B shows a view of the toe insert 60.

The body 10 includes a first material with a first specific gravity. The hosel insert 50 includes a second material with a second specific gravity. The toe insert 60 includes a third material with a third specific gravity. The second and third specific gravities are greater than the first specific gravity. The second and third specific gravities may be substantially equal, or the may be different. Providing substantially equal second and third specific gravities provides equal balance to the club head 2. Providing a second specific gravity that is greater than the third specific gravity provides more mass in the heel 15 of the club head 2, biasing the club head center of gravity towards the heel 15. This may be desired for a golfer that tends to slice the ball, since biasing the club head center of gravity toward the heel 15 makes the club easier to close, decreasing the likelihood of leaving the club head open at impact. Alternatively, providing a third specific gravity that is greater than the second specific gravity provides more mass in the toe 16 of the club head 2, biasing the club head center of gravity towards the toe 16. This may be desired for a golfer that tends to hook the ball, since biasing the club head center of gravity toward the toe 16 makes the club harder to close, decreasing the likelihood of closing the club head too soon or too much at impact.

The larger a club head's MOI, the more resistance the club head has to this shot-altering twisting. In other words, the larger a club head's MOI, the more forgiving and playable the golf club is. With a large MOI, a golf club will still produce a straight ball flight for shots that are not struck precisely in line with the club head center of gravity. Important axes for which to have large MOI include the vertical and horizontal axes passing through the club head center of gravity. Moving the inserts 50, 60 further away from the club head center of gravity increases the MOI's. Providing a high hosel insert 50 and a low toe insert 60 increases the MOI about both the vertical and horizontal axes.

The club head 2 preferably has a MOI as measured about a vertical axis passing through the center of gravity greater than 250 $kg \cdot mm^2$. This vertical axis MOI preferably may be from 250 $kg \cdot mm^2$ to 300 $kg \cdot mm^2$. The club head 2 preferably has a MOI as measured about a horizontal axis passing through the center of gravity greater than 55 $kg \cdot mm^2$. This horizontal axis MOI preferably may be from 55 $kg \cdot mm^2$ to 65 $kg \cdot mm^2$.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents.

What is claimed is:

1. A golf club head, comprising:

a body defining a front surface, a top line, a sole, a back, a heel, and a toe, said back containing a recess in only a lower portion thereof, said recess extending toward said sole, said body formed of a material having a first specific gravity; and an insert positioned within said recess, said insert being configured to matingly correspond to said recess, said insert having a second specific gravity less than said first specific gravity;

wherein said back is substantially free of any cavity; and wherein said insert extends above said recess along said back to form a muscle of the club head;

wherein said insert comprises a lock groove to couple said insert and said body; and wherein said insert further comprises a rib to impose a preload upon said body, and wherein said rib swages into a rear surface of said front surface.

2. The golf club head of claim 1, wherein said body opposite the lock groove swages into the lock groove.

3. The golf club head of claim 1, wherein said first specific gravity is at least 8.

4. The golf club head of claim 1, wherein said second specific gravity is at most 8.

5. The golf club head of claim 4, wherein said first specific gravity is at least 8.

6. The golf club head of claim 1, wherein said body is forged.

7. The golf club head of claim 1, wherein said insert is metallic.

8. The golf club head of claim 1, wherein said insert substantially fills said recess.

9. A golf club head, comprising:

a body defining a front surface, a top line, a sole, a back, a heel, and a toe, said back containing a recess in only a lower portion thereof, said recess extending toward said sole, said body formed of a material having a first specific gravity; and an insert positioned within said recess, said insert being configured to matingly correspond to said recess, said insert having a second specific gravity less than said first specific gravity;

wherein said insert comprises a lock groove to couple said insert and said body;

wherein said insert further comprises a rib to impose a preload upon said body;

wherein said rib swages into a rear surface of said front surface; and wherein said second specific gravity is at most 5.

10. The golf club head of claim 9, wherein said insert extends above said recess along said back to form a muscle of the club head.

11. The golf club head of claim 9, wherein said back is substantially free of any cavity.

12. The golf club head of claim 9, wherein said body swages into the lock groove.

13. The golf club head of claim 9, wherein said first specific gravity is at least 8.

14. The golf club head of claim 9, wherein a difference between said first and second specific gravities is at least 3.

15. The golf club head of claim 9, wherein said body is forged.

16. The golf club head of claim 9, wherein said insert is metallic.

17. The golf club head of claim 9, wherein said insert substantially fills said recess.

18. A golf club head, comprising:

a body defining a front surface, a top line, a sole, a back, a heel, and a toe, said back containing a recess in only a lower portion thereof, said recess extending toward said sole, said body formed of a material having a first specific gravity; and an insert positioned within said recess, said insert being configured to matingly correspond to said recess, said insert having a second specific gravity less than said first specific gravity;

wherein said insert comprises a lock groove to engage with said body to retain said insert within said recess;

wherein said insert further comprises a rib to impose a preload upon said body;

wherein said rib swages into a rear surface of said front surface; and wherein a difference between said first and second specific gravities is at least 3.

19. The golf club head of claim 18, wherein said insert extends above said recess along said back to form a muscle of the club head.

20. The golf club head of claim 18, wherein said back is substantially free of any cavity.

21. The golf club head of claim 18, wherein said body swages into the lock groove.

22. The golf club head of claim 18, wherein said first specific gravity is at least 8.

23. The golf club head of claim 18, wherein said second specific gravity is at most 8.

24. The golf club head of claim 23, wherein said first specific gravity is at least 8.

25. The golf club head of claim 18, wherein said second specific gravity is at most 5.

26. The golf club head of claim 18, wherein said body is forged.

27. The golf club head of claim 18, wherein said insert is metallic.

28. The golf club head of claim 18, wherein said insert substantially fills said recess.

* * * * *